United States Patent [19]

Sutherland et al.

[11] 4,448,068

[45] May 15, 1984

[54] SHALLOW WATER ENVIRONMENTAL/OCEANOGRAPHIC MEASUREMENT SYSTEM

[75] Inventors: Alexander L. Sutherland; Richard C. Swenson, both of Carriere, Miss.

[73] Assignee: The United States of America as represented by the Secretary of the Navy, Washington, D.C.

[21] Appl. No.: 298,053

[22] Filed: Aug. 31, 1981

[51] Int. Cl.[3] ..... B63B 35/00

[52] U.S. Cl. ..... 73/170 A; 441/33

[58] Field of Search ..... 73/170 A; 441/33, 6

[56] References Cited

U.S. PATENT DOCUMENTS

| | | | |
|---|---|---|---|
| 3,329,015 | 7/1967 | Bakke et al. | 73/170 |
| 3,336,799 | 8/1967 | Kermode | 73/170 |
| 3,405,558 | 10/1968 | Koot | 73/170 A |
| 3,455,159 | 7/1969 | Gies | 73/170 A |
| 3,762,214 | 10/1973 | Bogusz | 73/61 |
| 4,089,209 | 5/1978 | Grana et al. | 73/61 |
| 4,193,057 | 3/1980 | Bennett | 441/33 |

FOREIGN PATENT DOCUMENTS

| | | | |
|---|---|---|---|
| 1248901 | 12/1971 | United Kingdom | 73/170 A |

OTHER PUBLICATIONS

National Technical Report; vol. 26, No. 1; Feb. 1980, "APODAS"; English Abstract and p. 73.

*Primary Examiner*—Charles E. Frankfort
*Assistant Examiner*—Denis E. Corr
*Attorney, Agent, or Firm*—R. F. Beers; F. I. Gray

[57] ABSTRACT

A shallow water environmental/oceanographic measurement system for real time monitoring of specific parameters at a particular location. A three point moored buoy is anchored over the particular location. Bottom mounted sensors to measure the specific parameters are situated generally within the area of the three point mooring area. Sensor data is transmitted via cable to the buoy from where it is telemetered to a shore station.

3 Claims, 2 Drawing Figures

SHALLOW WATER ENVIRONMENTAL/OCEANOGRAPHIC MEASUREMENT SYSTEM

BACKGROUND OF THE INVENTION

1. Field of the Invention

The present invention relates to oceanographic measurement systems, and more particularly to a shallow water environmental/oceanographic measurement system which provides a real time monitoring system for specific parameters at a particular location.

2. Description of the Prior Art

Salt mounds located along the Gulf of Mexico in the states of Texas and Louisiana, if evacuated of their brine contents, could form extensive natural storage cavities. The brine content would be pumped out of these mounds and deposited via pipeline and diffuser into the Gulf of Mexico. It is desired to assess the total ecosystem impact on the receiving waters and biota from the discharge of these saturated brine solutions.

SUMMARY OF THE INVENTION

Accordingly, the present invention provides a shallow water environmental/oceanographic measurement system for real time monitoring of specific parameters at a particular location. A three point moored buoy is anchored over the particular location. Bottom mounted sensors to measure the specific parameters are situated generally within the area of the three point mooring area. Sensor data is transmitted via cable to the buoy from whence it is telemetered to a shore station.

Therefore, it is an object of the present invention to provide a shallow water environmental/oceanographic measuring system which gives a real time display of specific parameters at a particular location to a remote site.

Another object of the present invention is to provide a shallow water environmental/oceanographic measurement system the sensors of which are protected from being snagged in trawl nets.

Other objects, advantages and novel features of the present invention will be apparent from the following detailed description when read in conjunction with the appended claims and attached drawing.

DESCRIPTION OF THE PREFERRED EMBODIMENT

Figure 1:
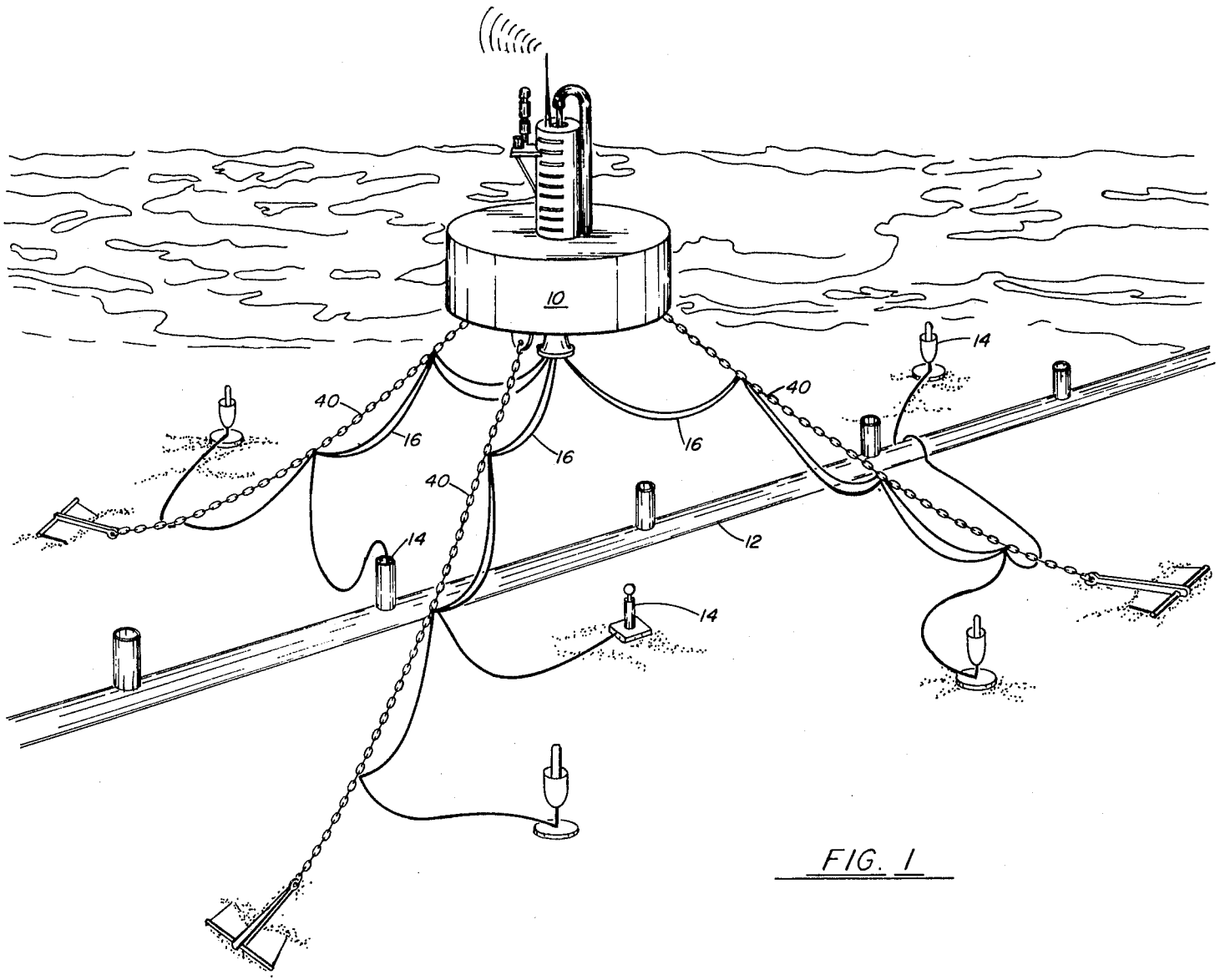
FIG. 1 is a perspective view of a shallow water environmental/oceanographic measurement system according to the present invention.

Referring now to FIG. 1 a shallow water environmental/oceanographic measurement system is shown. A three point moored buoy 10 is anchored over a pipeline diffuser 12 or other site of particular interest. A plurality of bottom mounted sensors 14 to measure parameters such as conductivity, temperature, current and flow transmit their data via cables 16 to the buoy 10. The data is telemetered to a remote site such as a shore station for real time display. To protect the sensors 14 from damage due to trawlers the sensors are either placed within the protective barrier of the mooring system, or are mounted in such a way as to be compliant with over-passing trawler nets as disclosed in co-pending patent application Ser. No. 6-294667 entitled "A Trawl Resistant Sensor Mount" filed Aug. 20, 1981 by Alexander L. Sutherland with the sensor cables 16 buried below the sea floor.

Figure 2:
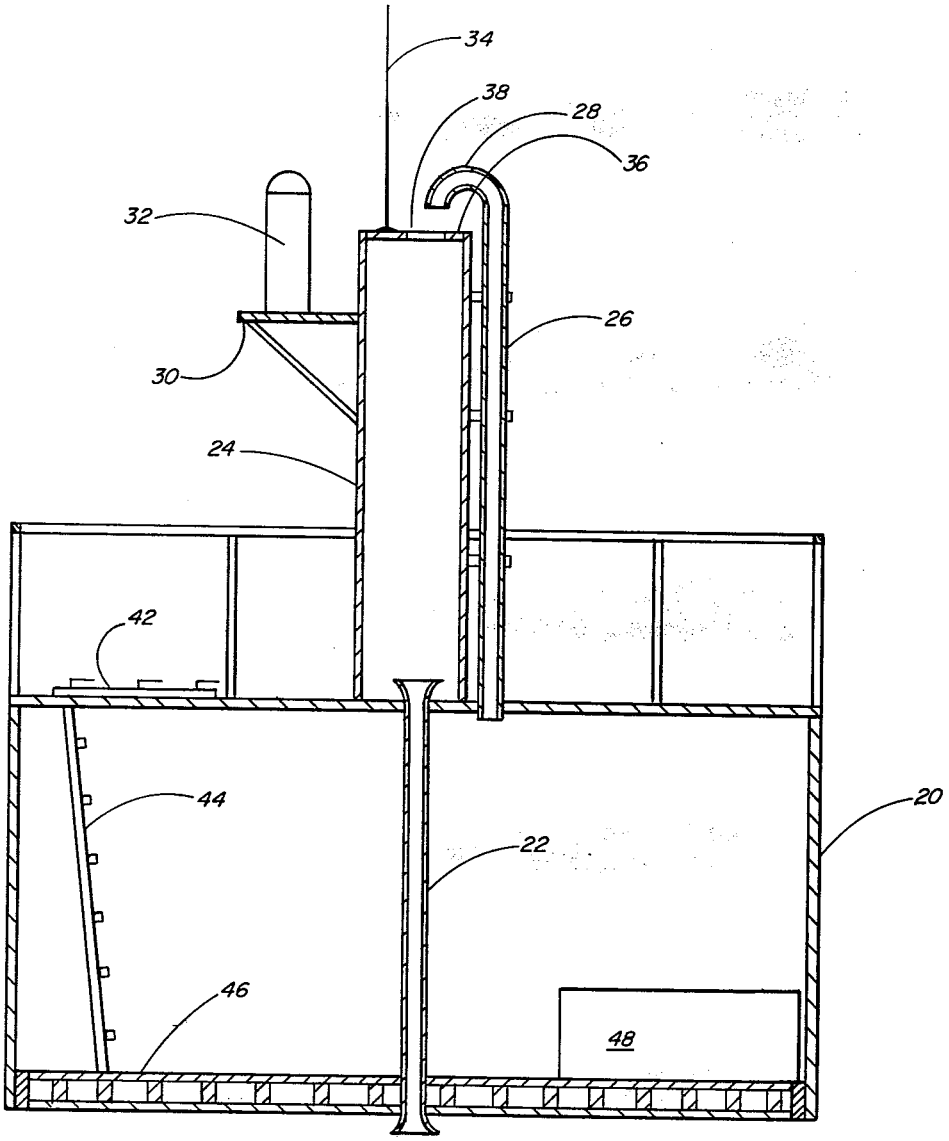
FIG. 2 is a cross-sectional view of a buoy platform for the shallow water environmental/oceanographic measurement system according to the present invention.

A standard cylindrical buoy 20 has a hawse pipe 22 through the center along the axis as shown in FIG. 2. A large diameter pipe 24 is mounted on top of the buoy 20 to enclose the top end of the hawse pipe 22. A taller, small diameter pipe 26 having a gooseneck 28 at the top is mounted on the buoy 20 next to the large diameter pipe 28. The bottom of the small diameter pipe 26 penetrates the upper surface of the buoy 20 to provide access to the interior. The gooseneck 28 extends over the top end of the large diameter pipe 24. A platform 30 is attached to the large diameter pipe 24 near the top to support a warning device 32 such as a fog horn and/or light. A telemetry antenna 34 is mounted either on the platform 30 or on a cap 36 enclosing the top of the large diameter pipe 24. The cap 36 has an appropriate opening 38 to allow the sensor cables 16 to pass through.

The sensor cables 16 may run up the mooring chains 40 as shown in FIG. 1. However, for light cables 16 in rough seas with poor diver visibility and to prevent the cables from wrapping around the chains 40, the cables may be led directly to the sensors 14. The sensor cables 16 enter the lower end of the hawse pipe 22, pass through the hawse pipe and the large diameter pipe 24, and enter the interior of the buoy 20 via the small diameter pipe 26. This routing scheme provides excellent protection against water intrusion, yet provides a simple means for accepting more cables 16 into the buoy 20 for additional sensors 14, making the system flexible. The small diameter pipe 26 also serves as an air vent for ventilating an air battery system. The large diameter pipe 24 serves as a protector for the sensor cables 16 and as structural bracing for the small diameter pipe 26.

A hatch 42, ladder 44 and deck grating 46 provide access for personnel to the interior of the buoy 20. A battery rack and water tight electronics package 48 is located in the interior of the buoy 20 to provide the necessary power and data processing to activate the warning device 32 and transmit the data from the sensors 14 via the antenna 34 to a remote receiving site.

Thus, the present invention provides a shallow water environmental/oceanographic measurements system which gives real time displays of specific parameters from a particular location at a remote site, which has the ability to expand the number of sensors used according to measurement requirements, and which protects the sensors from entanglement with trawler nets.

What is claimed is:

1. A shallow water environmental/oceanographic measurement system comprising:

a moored cylindrical buoy having a central hawse pipe, said cylindrical buoy being anchored at multiple points over a particular location and containing an electronics package;

a first pipe mounted on said cylindrical buoy, said first pipe enclosing the upper end of said hawse pipe;

a second pipe having a gooseneck at the top, said second pipe being mounted on said cylindrical buoy such that the bottom of said second pipe extends into the interior of said cylindrical buoy and said gooseneck extends over the upper end of said first pipe;

a plurality of sensors mounted on the sea floor within the moor area of said cylindrical buoy, said sensors being connected to said electronics package in said cylindrical buoy by electrical cables over which sensor data is transmitted; and means connected to said electronics package for transmitting said sensor data to a remote site, said transmitting means being mounted on said cylindrical buoy;

whereby said electrical cables from said sensors are routed through said hawse pipe, said first pipe and said second pipe to said electronics package in the interior of said cylindrical buoy.

2. A measurement system as recited in claim 1 further comprising means for obtaining access to the interior of said cylindrical buoy for servicing said electronics package.

3. A measurement system as recited in claims 1 or 2 further comprising means mounted on said cylindrical buoy for warning vessels of the presence of said measurement system.

* * * * *